United States Patent [19]

Jones

[11] Patent Number: 4,976,054

[45] Date of Patent: Dec. 11, 1990

[54] SNOWPLOW LEVELING SYSTEM

[76] Inventor: Daniel K. Jones, 5337 Reiner Rd., Madison, Wis. 53704

[21] Appl. No.: 415,986

[22] Filed: Oct. 2, 1989

[51] Int. Cl.[5] ..... E01H 5/04

[52] U.S. Cl. ..... 37/235; 37/283; 37/DIG. 20; 15/82; 172/821; 172/829

[58] Field of Search ..... 37/234, 235, 236, 266, 37/270, 271, 279, 283, DIG. 20; 172/818, 819, 820, 821, 822, 823, 828, 829; 15/82

[56] References Cited

U.S. PATENT DOCUMENTS

| | | | |
|---|---|---|---|
| 2,094,515 | 9/1937 | Abbe | 37/270 X |
| 2,792,650 | 5/1957 | Kenyon | 37/283 X |
| 3,303,589 | 2/1967 | Rivinius | 172/4.5 |
| 3,793,752 | 2/1974 | Snyder | 37/234 |
| 3,803,733 | 4/1974 | Ramsey | 37/273 |
| 4,197,032 | 4/1980 | Miller | 37/DIG. 20 X |
| 4,254,564 | 3/1981 | Rath | 37/236 |
| 4,405,019 | 9/1983 | Frisbee | 172/816 |
| 4,446,639 | 5/1984 | Bohn | 37/280 |
| 4,450,635 | 5/1984 | Shwayder | 37/271 |
| 4,487,269 | 12/1984 | Frisbee | 172/818 |
| 4,528,762 | 7/1985 | Sarka et al. | 37/236 |
| 4,821,436 | 4/1989 | Slocum | 37/235 |

*Primary Examiner*—Randolph A. Reese
*Assistant Examiner*—Arlen L. Olsen
*Attorney, Agent, or Firm*—Andrus, Sceales, Starke & Sawall

[57] ABSTRACT

A snowplow leveling system is described for use on a standard plow mounting structure having a reversing table mounted to a plow blade system and rotatably mounted on a support frame. The support frame is pivotally mounted about a horizontal axis onto a motor vehicle which has an elevatable lifting point. The snowplow leveling device is mounted on the support bar of the reversing table. The leveling device may include two slider mechanisms mounted on support tracks located on opposite ends of the support frame of the reversing table. Positioning struts hingedly connect the slider mechanisms to the support frame. Additionally, a lifting chain connected at each end to the slidable mechanisms and in the middle to a lifting hitch attached to the support frame aids in maintaining the leveling position of the snowplow system of the present invention.

48 Claims, 8 Drawing Sheets

SNOWPLOW LEVELING SYSTEM

FIELD OF THE INVENTION

The present invention relates generally to snowplows and snowplow attachments for mounting on motor vehicles, and in particular to a system for maintaining the blade of a snowplow level to the ground regardless of height raised above ground or plowing angle.

BACKGROUND OF THE INVENTION

Snowplows are commonly used to plow snow from roadways, parking lots and other areas. The snowplow generally consists of a plow blade, including a moldboard and a blade edge, a plow frame commonly known as a reversing table, and a support frame also referred to as an A-frame, which may be detachably mounted on the front of a motor vehicle. The snowplow blade system may be removed during snow-free months to allow other uses for the vehicle.

The snowplow blade commonly includes a blade edge mounted on a moldboard which is attached to a curved steel device, known as a reversing table. The reversing table is adapted to rotate in either direction along a supporting frame, which is generally in the shape of an A-frame. The frame is connected to the front of the motor vehicle. An upper lift arm, lifted by a hydraulic cylinder, is also attached to the front of the motor vehicle. A lifting chain, cable or lifting bar is typically attached to both sides of the reversing table and over a support mechanism in the form of a pully, link, hook, chainblock or clevis depending from the lift arm. Thus, when the upper lift arm is pivoted upwards the A-frame, the reversing table and moldboard are all raised upward and clear of the ground for transport of the motor vehicle and plow. By rotating the reversing table, either by hand or by means of hydraulic cylinders or a hydraulic motor mounted on the A-frame, it is possible to plow snow directly ahead of the plow in the manner of a bulldozer, or off to the left or right.

Prior art snowplows of this type have the drawback that when the plow assembly is lifted with the moldboard in a left or right of center position, the plow blade tilts at an angle toward the ground. The angle may be different depending on the type of blade, the nature of the mounting device and the type of vehicle to which the snowplow blade is attached. The result of this tilting is that the plow must be raised higher off the ground to clear all portions of the plow blade. This high, raised position makes the vehicle unstable and causes substantial strain on the mounting device. Additionally, there are conditions, generally deep snow, when plowing tactics require raising the blade a distance off the ground to "top" the snow. This form of "off ground" plowing is extremely difficult if the plow blade cannot be kept level to the ground. Furthermore, when the plow blade is raised to such a height to clear the ground, it tends to obscure the view of the driver of the motor vehicle. An additional problem occurs when the tilted moldboard and blade is lowered onto the ground, causing uneven wear on the corner which strikes the ground first.

SUMMARY OF THE INVENTION

The present invention overcomes the above-mentioned difficulties by providing a snowplow blade leveling system which keeps the edge of the snowplow blade equidistant from the ground at all times. Specifically, the present invention relates to a plow blade leveling system comprising a plow blade support frame adapted to be attached to a motor vehicle. The support frame includes means to slidably receive a lifting chain. The plow blade leveling system also includes a reversing tray including a front support bar having a first and second end. The reversing tray is rotatably mounted to the support frame and is adapted to receive a plow blade for plowing. The system also includes a leveling system slidably attached to the support frame of the reversing tray in order to maintain the reversing tray in a position level to the ground.

The present invention is further directed to a snowplow comprising a motorized vehicle, a plow blade support frame attached to the motorized vehicle, wherein the support frame includes means to slidably receive a lifting chain, a reversing tray including a first support bar having a first end and a second end, the reversing tray being rotatably mounted to the support frame, a plow blade mounted on the reversing tray, and a leveling device slidably attaching the reversing tray to the support frame to maintain the reversing tray in a position level to the ground.

Further, the present invention is directed to a plow blade leveling system comprising, in addition to the support frame and the reversing tray, a leveling device slidably attached to the support frame of the reversing tray to maintain the reversing tray in a position level to the ground. The leveling device includes first and second collars, such that the first collar is slidably attached to a first support bar at a location near the first end of the reversing tray and the second collar is slidably attached to a second support bar at a location near the second end of the reversing tray. A lifting chain, which supports the reversing tray, has a first end and a second end, the first end being connected to the first collar and the second end being connected to the second collar. The leveling device also includes first and second positioning struts hingedly attaching the first and second collars respectively to the support frame.

Additionally, the present invention is directed to a plow blade leveling system comprising, in addition to the plow blade support frame and a reversing tray, a leveling device slidably attached to the support bar of the reversing tray to maintain the reversing tray in a position level to the ground. The leveling device includes a first collar and a second collar, the first and second collars being slidably attached directly to the support bar of the reversing table. The leveling device further includes first and second positioning struts hingedly attaching the first and second collars respectively to the support frame.

The present invention is further directed to a plow blade leveling system comprising a plow blade support frame and a lift arm adapted to be attached to a motor vehicle, and a reversing tray including a front support bar having a first end, a second end, a top surface, a bottom surface and a forward side. The reversing tray is rotatably mounted on the support frame. The reversing tray is further adapted to receive a plow blade for plowing. The plow blade leveling system includes a leveling device having a cable system slidably positioning the reversing tray in a level position with respect to the support frame and the lift arm. The front support bar of the reversing tray includes a right exterior guide, a left exterior guide, a right interior guide and a left interior guide. The lift arm has a first cable connection attached to it. The support frame includes a second cable connection attached to it. The cable system further includes at least one flexible cable fixedly attached to the second cable connection and slidably positioned on the exterior and interior guides and the first cable connection in order to keep the reversing tray level at any position of rotation with respect to the support frame.

An advantage to the present invention is that the snow plow blade levelers will always maintain the bottom edge of the snowplow blade in parallel relationship relative to the ground. That is, the blade will not wear unevenly, which would result if the angle of the blade approached the ground at an angle other than parallel. The leveling system of the present invention operates efficiently whether the plow blade is on the roadway or lifted above the ground during the operation. This is advantageous especially when the snowplow is operating on uneven terrain, such as gravel roads or ground, and when the snowplow is "off ground" plowing.

Further objects, features and advantages of the invention will be apparent from the following detailed description when taken in conjunction with the accompanying drawings.

DETAILED DESCRIPTION OF THE INVENTION

Figure 1:
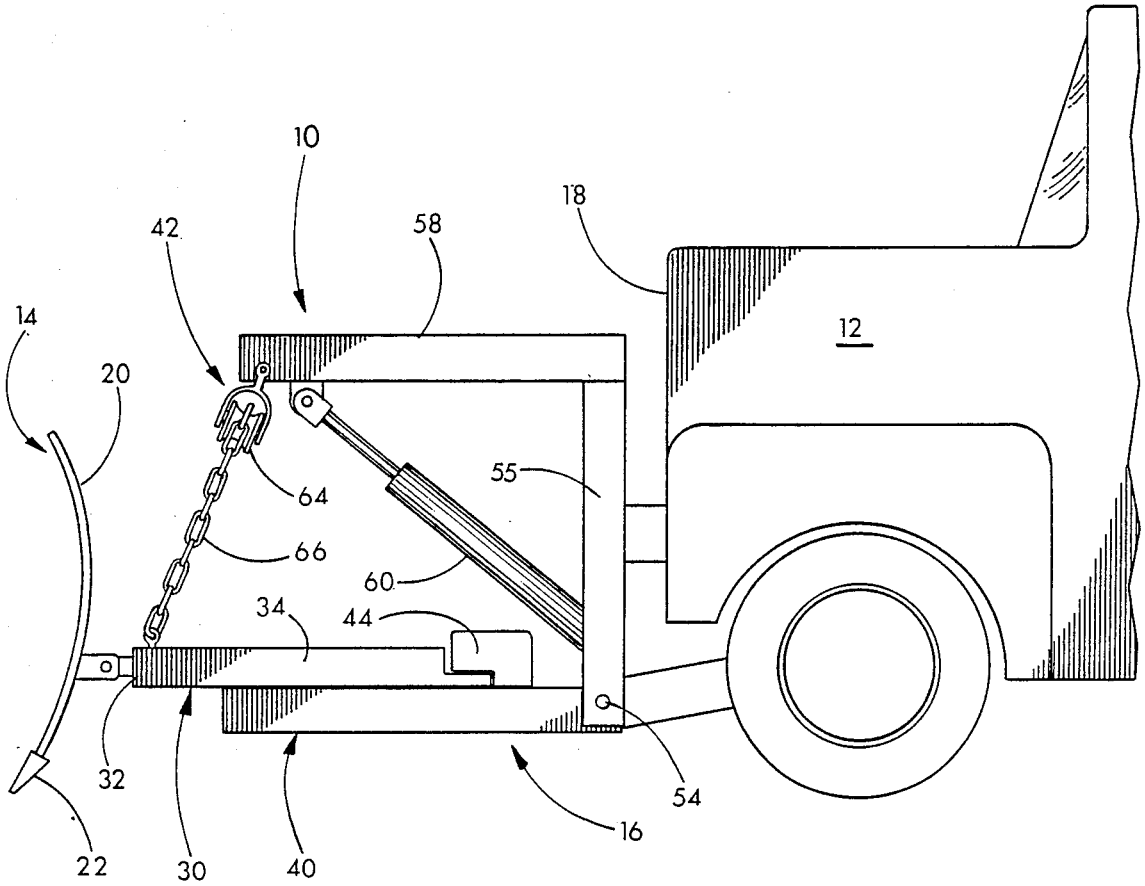
FIG. 1 is a side elevation view of a snowplow system mounted on a motor vehicle.

Referring now to the drawings, wherein like reference numbers refer to like elements throughout the several views, FIG. 1 illustrates a conventional snowplow system 10 including a motor vehicle 12 having a snowplow blade 14 and mounting equipment 16 mounted on the front end 18 of the vehicle 12. Examples of snowplow systems within the scope of this invention, which can be adapted to incorporate the leveling system of the present invention, include, but are not limited to, those produced by the Gledhill Road Machinery Company, American Road Machiney, Inc., Balderson, bonnin Products, Inc., Bonnell Industries, Inc., Braun's Welding Service, Inc., Coates Manufacturing, Inc., Diamond Machine Co., Dierzen Welding & Machine Co., Everest, Little Falls Machine, Inc., Flink Co., Frink America, Industech, Inc., Lansco Corp., Ramtec Limitee, Root Spring Scraper Company, Tenco Machinery Ltd., Valk Manufacturing Co., Good Roads Products, Henke Manufacturing Corp., Viking Manufacturing Corp., Universal Highway Products and Schmitt Engineering & Equipment Co. Ltd.

As used herein, the term "snowplow blade" includes all manner of moldboard blades and grading devices designed for use in connection with a vehicle, preferably a motorized vehicle. It is within the scope of the present invention to include a roller brush system in place of a snowplow blade. Thus, the blades incorporated within this invention include blades adapted for use with small garden or grain-type tractor vehicle up to the heavy equipment suitable for road work. It is within the scope of the present invention to include a number of different types of vehicles within the term "motor vehicle," including but not limited to conventional snowplow and bulldozer vehicles, light and heavy trucks, automobiles, tractors and ride-on lawn mowers. The only requirement is that the vehicle be adapted to either permanently or temporarily mount a snowplow blade. The mounting mechanism for the snowplow blade is conventional to the art and does not form a part of the present invention. For example, reference is made to U.S. Pat. Nos. 4,254,564 and 4,528,762 for illustrations of typical snowplow blade mounting mechanisms.

The snowplow blade system 14 in FIG. 1 is a standard moldboard type plow including a moldboard 20 and a plowblade 22 attached to the lower end of the moldboard 20. The plow blade 20 is generally constructed of a strong, high impact material, such as steel, in order to prevent damage to the blade system 14 as it is being used for shoveling snow. The blade system 14 is mounted on a reversing table 30 which is rotatably mounted on a support frame 40. The support frame 40 is mounted to a lifting hitch 42 which is rigidly attached to the motor vehicle 12. The plowblade system 14, reversing table 30, support frame 40, lifting hitch 42 and most other parts of the mounting equipment 16 are of standard design and construction known to the art.

Figure 2:
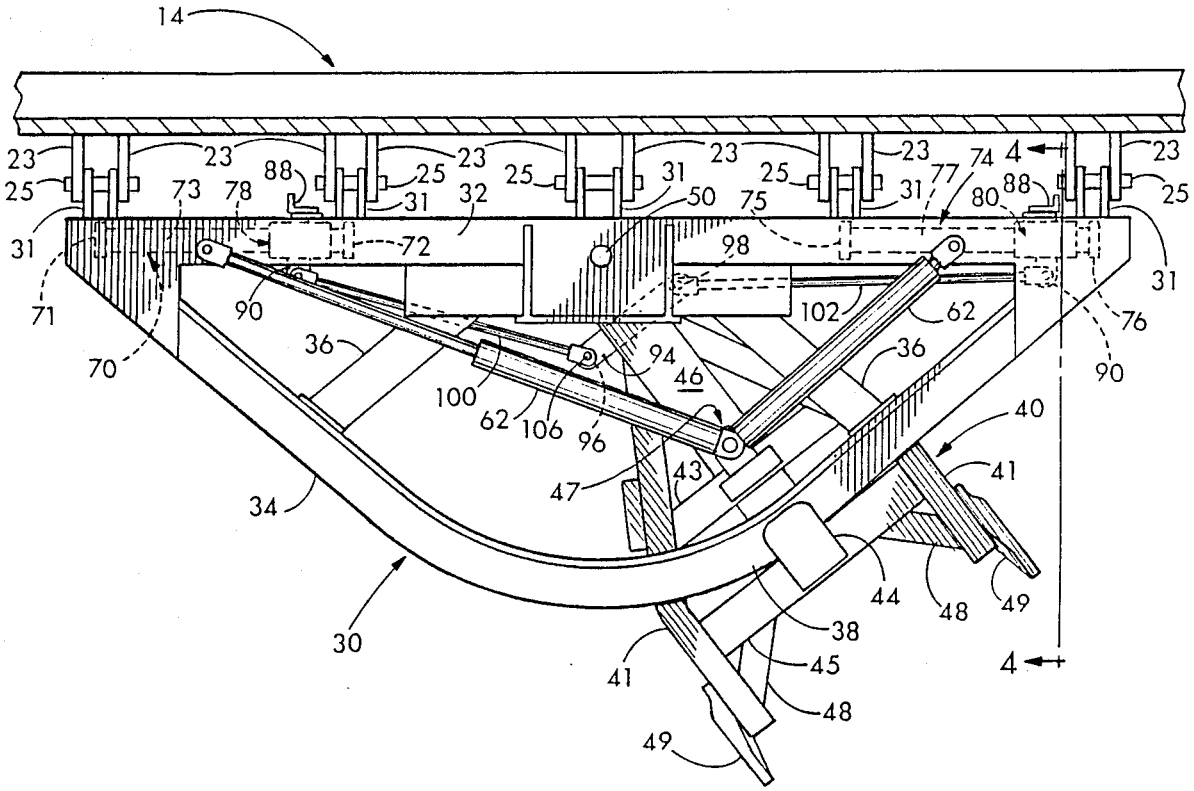
FIG. 2 is a top elevation view of a preferred embodiment of the snowplow leveling system of this invention attached to a reversing table and supporting frame of a snowplow mounting structure.
Figure 3:
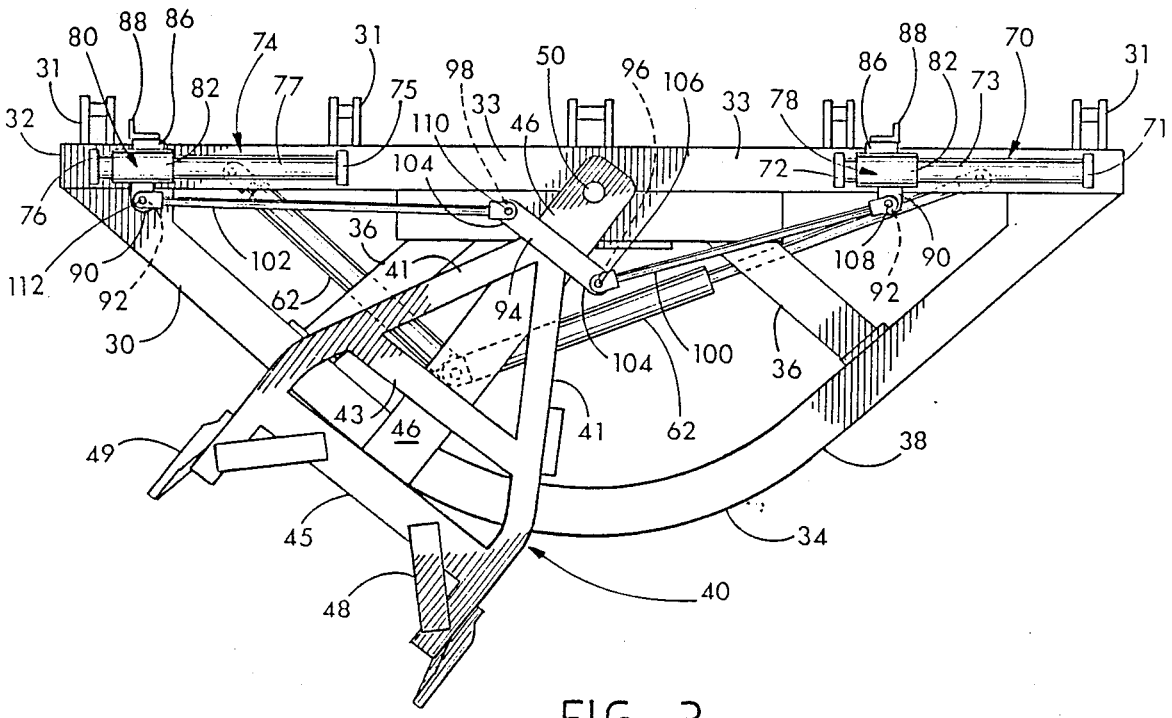
FIG. 3 is a bottom elevation view of the structure of FIG. 2.

Referring now to FIGS. 1–3, the reversing table 30 has a generally straight front support bar 32, which is rigidly attached to a rearwardly extending arcuate angle brace 34 to form a rigid unitary structure. Stiffening members 36 extend between the support bar 32 and the angle brace 34 for the purpose of structurally rigidifying the reversing table 30. The angle brace 34 has a projecting lip 38. The projecting lip 38 is designed to be movably connected to the support frame 40 by being slidably placed between an overhanging projecting member 44 and a center support bar 46. The plow blade system 14 is mounted on the reversing table 30 by pins 25 connecting ears 23 on the moldboard 22 to the lugs 31 on the reversing table 30.

Referring now more particularly to FIGS. 2 and 3, the support frame 40 is a rigid generally flat truss which may be in the form of the standard A-frame. Two angled side beams 41 are joined to each other and are made rigid by a transverse front cross beam 43 and a rear cross beam 45 which may be further supported by two gussets 48. The center support bar 46 bisects the frame and is attached, preferably by welding, to the rear cross beam 45, the front cross beam 43, and the side beams 41. Mounted on the center support bar 46 above the rear cross beam 45 is the projecting member 44.

The support frame 40 is rotatably connected at the forward end of the center support bar 46 to the support bar 32 of the reversing table 30 by a kingpin 50. Hydraulic reversing cylinders 62, which include hydraulic pistons, are pivotally mounted at one end to the center bar 46 at the cylinder assembly mount 47. The hydraulic reversing cylinders 62 are pivotally connected at the other end to the support bar 32 for adjusting the plowing angle of the snowplow blade system 14.

The support frame 40 is pivotally mounted about a horizontal axis defined by axially spaced lugs 54 which are fixedly attached to the lifting hitch 42 by means of attachment ears 49. It is also within the scope of the present invention to provide "quick hitch" attachment means, which are known to the art. As may best be seen in FIG. 1, the lifting hitch 42 has at least one and preferably two upright members 55 to which a cantilever beam 58 is pivotally attached. A lifting cylinder 60 is pivotally connected to the upright member 55 and the cantilever beam 58. A lifting hitch chain or cable pulley 64 is rotatably attached to the forward end of the cantilever beam 58.

In standard snow plow systems known to the art, the support beam 40 is provided with a lifting chain 66 attached at one end to the cantilevered beam 58 and at the other end to the support bar 32 of the reversing table 30. In another model (not illustrated), the lifting cable may be attached at one end to the left hand portion of the support bar 32 and at the other end to the right hand portion of the support bar 32. The middle portion of the lifting cable is positioned through the pulley 64, attached to the cantilevered beam, in a freely moving manner. The purpose of the lifting chain is to assist in supporting the support frame 40 and snowplow blade assembly 14. However, it has been observed that while the lifting cable does provide support, it is deficient in maintaining the snowplow blade system in a level manner, i.e., parallel to the ground, especially when the blade is lifted off the ground and most especially when the snowplow blade is facing to the right or left of center and lifted off the ground.

The present invention overcomes these deficiencies by providing a snowplow blade leveling system which is generally slidably mounted on the front support bar 32 of the reversing table 30. Each end of the lifting chain is slidably mounted to opposite ends of the support bar 32 on either side of the king pin 50 attachment. Additionally, there is provided a pair of positioning struts hingedly attached at one end to the bottom side of the center support bar 46. The other ends of the positioning struts are slidably and hingedly attached to the bottom of the front support bar 32 at opposite ends.

The improvements herein described will position the snowplow blade system equidistant from the ground along the entire cutting edge of the blade, regardless of the height above the ground to which the moldboard is raised and regardless of the moldboard plowing angle, whether the plowing angle be full right, bulldozed or straight ahead, full left or at any plowing angle in between those positions.

The snowplow blade leveling system, according to this invention, is able to substantially limit any tilting of the elevated blade at any plowing angle, or during a change in plowing angle, by maintaining a constant distance between the raising point of the snowplow hitch, i.e., the area of the lifting chain, pully and the lifting points located on the reversing table.

Figure 4:
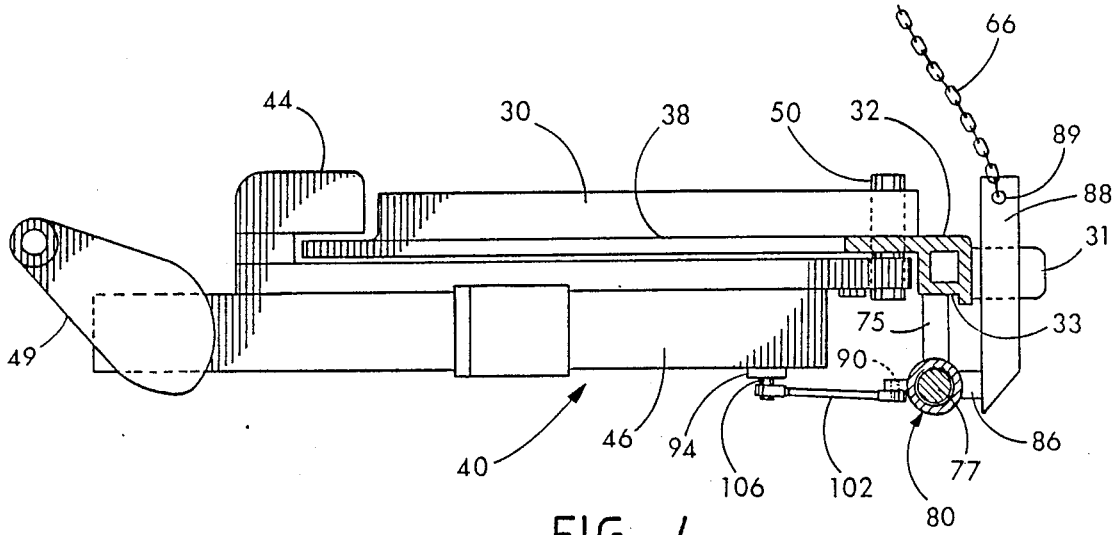
FIG. 4, is a side elevation view of the structure of FIG. 2.
Figure 5:
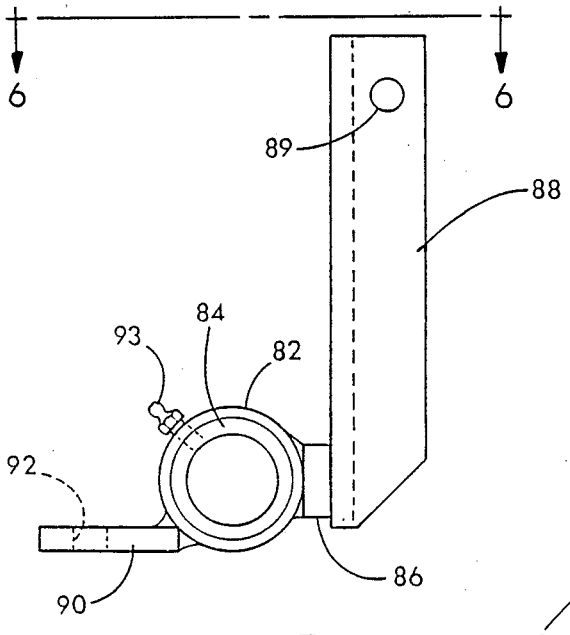
FIG. 5 is a side elevation view of a slider according to the preferred embodiment of the present invention.
Figure 6:
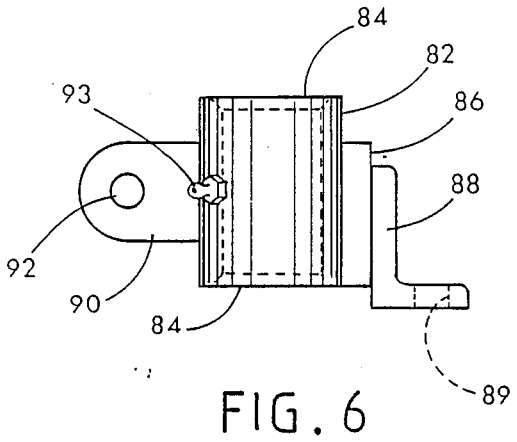
FIG. 6 is a top elevation view of the structure of FIG. 5.

Reference is now made to FIGS. 2–6 for a preferred embodiment of the present invention. As best seen in FIGS. 2–4, mounted on the support bar 32 are a left track member 70 and a right track member 74. The track members 70, 74 include downwardly depending supports 71, 72 and 75, 76 respectively, which are affixed to the bottom surface 33 of the support bar 32. Smooth-surfaced cylindrical bars or tubes 73, 77 respectively are rigidly affixed to the respective supports on the support bar 32. Slideably mounted on the left and right track members 70, 74 are a left slider 78 and a right slider 80. Referring now to FIGS. 5 and 6, each slider is a short cylindrical tube 82 with chamfered lips 84 welded or otherwise attached to a flat rectangular spacer 86 which is in turn welded to an upwardly extending vertical angle bracket 88. The angle brackets 88 on each of the left slider 78 and right slider 80 are the same, albeit mirror images of each other. The upper end of the angle bracket 88 includes an opening 89. Attached to the slide tube 82 of each slider at a right angle to the vertical angle bracket 88 is an ear 90 including an opening 92. Additionally, a grease fitting opening 93 may be placed in the slide tube 82 to facilitate movement of the slide tube along the track.

The left slider 78 is mounted on the reversing table 30 by fitting the slide tube 82 over the left track member 70. The right slider 80 is likewise mounted by fitting the slide tube 82 over the right track member 74. In order to keep the slide tube on the track, both supports 71, 72 and 75, 76 should be attached to the tracks. Optionally, it is possible to operate the snowplow system with only one track support holding the track.

Referring now to FIGS. 3 and 4, there is illustrated an attachment plate 94, which is a generally rectangular steel or similarly constructed plate with a left opening 96 and a right opening 98. The attachment plate 94 is rigidly welded or otherwise attached to the support frame 40 behind the kingpin 50 and perpendicular to the center support bar 46. Left and right rigid positioning struts 100, 102 hingedly join the sliders 78, 80 respectively to the attachment plate 94 and thus to the frame 40. The positioning struts 100, 102 are identical rigid rods with sets of opposing ears 104 having axially aligned holes. The left positioning strut 100 is hingedly connected at one end to the attachment plate 94 by a pin 106 through the holes in the ear 104, and at the other end is connected by a pin 108 through the ear 90 on the left slider 78. The right positioning strut 102 is connected at one end to the attachment plate 94 by a pin 110 through the holes in the ears 104 and is connected at the other end to the right slider 80 by a pin 112 through the ear 90. The lifting chain 66 is hooked onto the left slider 78 at the cable opening 89 in the vertical angle bracket 88. The lifting cable 66 runs from the left slider 78 over the cable pulley 64 and is hooked onto the right slider 80 at the cable opening 89 in the vertical angle bracket 88. The lifting chain 66 may be a chain, a braided or spun steel cable or any flexible cable with sufficient strength and flexibility to support the weight of the snowplow blade 22, the reversing table 30, and the support frame 40. The lifting cable 66 is long enough that when the lifting cylinder 60 is not extended and the cantilever beam 58 is not raised, the lifting cable 66 will be slack, and the plow blade 22 will rest on the ground.

To transport the plow blade 22, the lifting cylinder 60 forces the cantilever beam 58 upward. This upward force is transferred through the lifting chain 66 to the sliders 78, 80 which are mounted on the track members 70, 74. The entire composite structure rotates upward about the lugs 54 putting the plow blade 22 into a transport position. When the plow is raised, hydraulic fluid is locked in the lifting cylinder 60 and the plow can be transported from place to place without plowing. When the blade is to be used to plow, fluid is gradually exhausted from the lifting cylinder 60 and the plow blade 22 is lowered in a controlled fashion onto the roadway to be plowed. Thereafter, the motor vehicle 12 moves forward and begins plowing.

Figure 7:
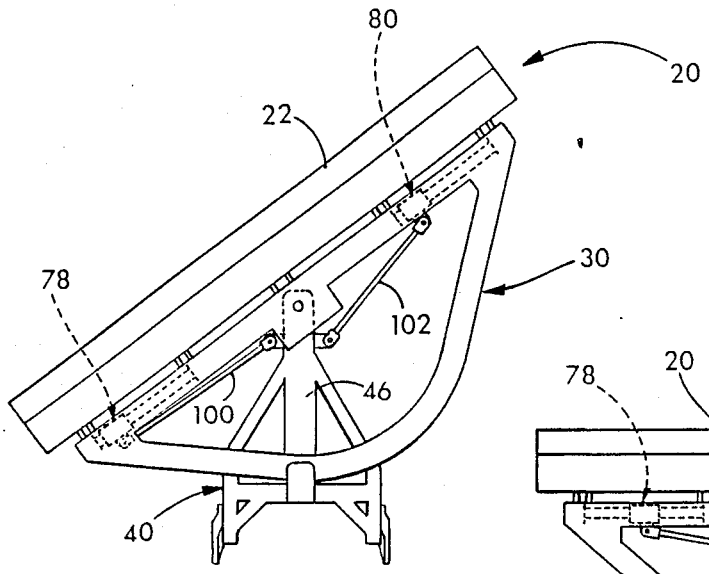
FIG. 7 is a simplified top plan view of the plow and mounting structure in a full left position.
Figure 8:
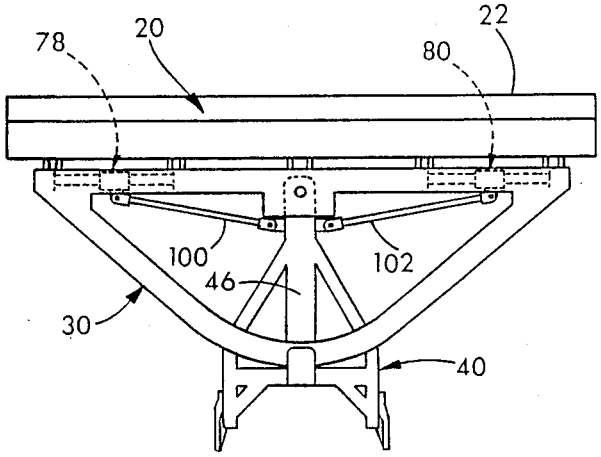
FIG. 8 is a simplified top plan view of the plow and mounting structure in a straight ahead, bulldoze position.
Figure 9:
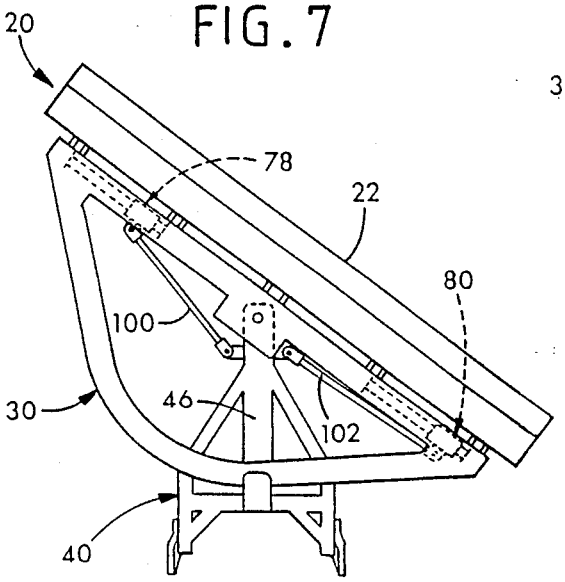
FIG. 9 is a simplified top plan view of the plow and mounting structure in a full right plowing position.

Referring now to FIGS. 7–9, the reversing cylinders 62 operate to pivot the reversing table 30 and the plow blade system 14 about the king pin 50. By expanding one reversing cylinder 62 while contracting the other, the plow blade 22 may be placed in any desired plowing angle ranging from the full left plowing angle of FIG. 7 to the straight ahead or bulldoze plowing angle of FIG. 8 to the full right plowing angle of FIG. 9. When the plow is in the bulldoze position of FIG. 8, the sliders 78, 80 are equally spaced from the center support bar 46. In order for the plow blade 22 to be held level above the roadway when being transported, the lengths of lifting cable 66 must be the same between each slider 78, 80 and the cable pulley 64. As the plowing angle is changed by rotating the reversing table 30, the distance between fixed points on the support bar 32 on opposite sides of the center bar 46 and the fixed cable pulley 64 will cease to be equal. If the distance between each lifting point and the cable pulley 64 differs, the result will be a drooping of the snowplow blade 22 on the side with the greater length of chain. To counteract this effect, the sliders 78, 80 are always maintained a fixed distance from the cable pulley 64 by the positioning struts 100, 102. For example, as seen in FIG. 7, when the plow is put into a full left position, the left slider 78 slides leftward along the left track member 70 away from the center bar 46 while the right slider 80 slides leftward along the right track member 74 towards the center bar 46. Thus the left slider 78 moves farther away from the center bar 46 as the points on the support bar 32 are brought closer to the center bar 46. The right slider 80 exhibits the same counteracting motion, moving closer to the center bar 46 as the rotation of the support bar 32 moves the points on the support bar 32 farther away from the center bar 46. As a result of the changing position of the sliders 78, 80, the segments of the lifting cable 66 between the sliders 78, 80 and the cable pulley 64 always remain equivalent in length and the plow blade system 14 always remains equidistant from the roadway regardless of the elevation of the plow blade 22 or the plowing angle.

It is within the scope of the present invention to construct the snowplow leveling system with any useful materials designed to withstand the rigors, weather and stress of a snowplow operation. A preferred material for the sliders and the slider supports is steel; however, it is contemplated that a high impact, weather resistant plastic or other metals may also be used.

It is also within the scope of the present invention to provide the preferred embodiment described above with a shape other than cylindrical for the slider tubes 78, 80 and the track members 70, 74. For example, it is contemplated that a triangular, squared or other multisided shape could be used instead of a cylinder.

Figure 10:
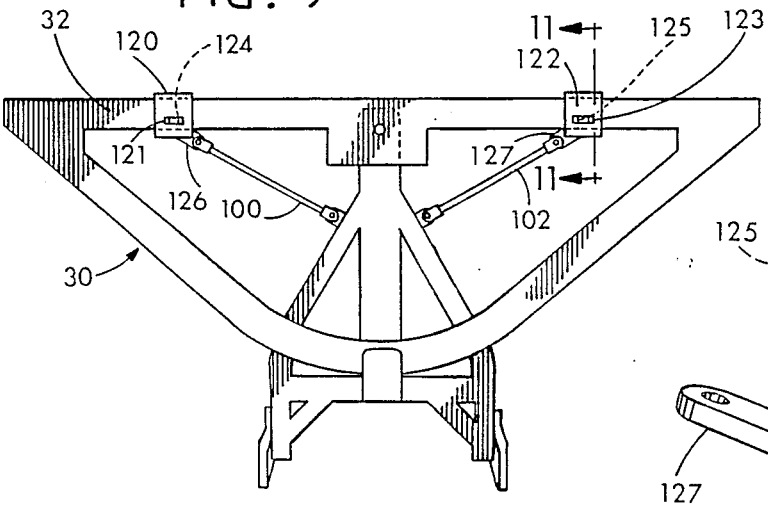
FIG. 10 is a top elevational view of a reversing table and support frame of a snowplow system illustrating a second embodiment of the present invention.
Figure 11:
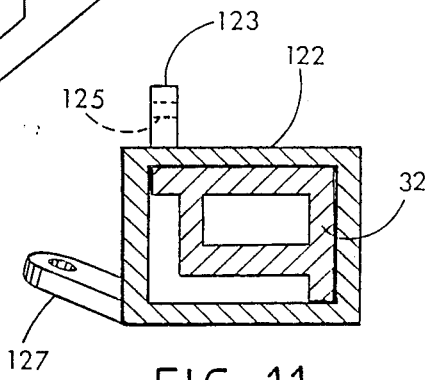
FIG. 11 is a side sectional of the invention of FIG. 10 taken along lines 11—11 of FIG. 10.
Figure 12:
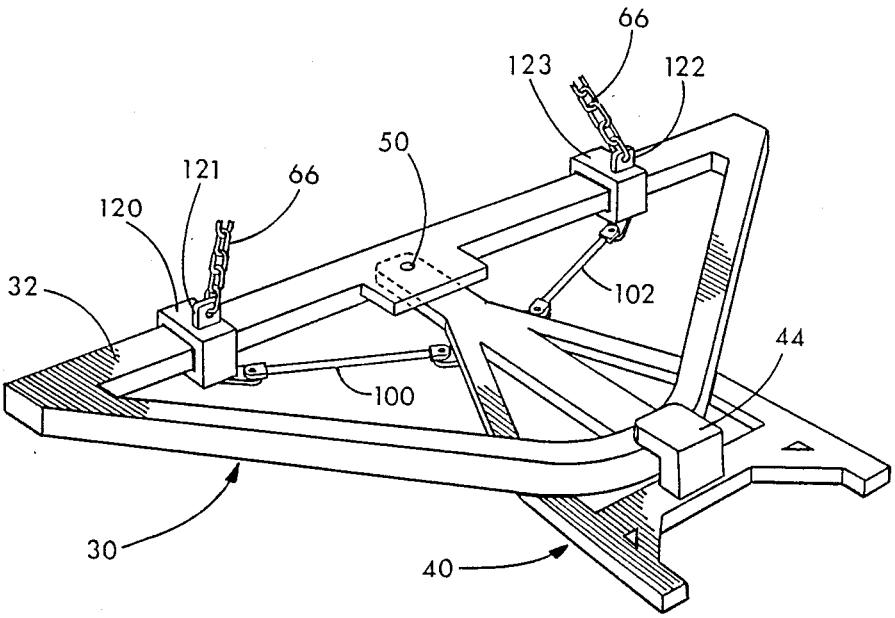
FIG. 12 is a perspective view of the invention of FIG. 10.

Reference is now made to FIGS. 10–12 for a second embodiment of the present invention. Rather than utilizing the track members 70, 74 and the sliders 78, 80 as illustrated in FIGS. 2–6, the present invention also contemplates a left and right collar 120, 122 respectively, which is adapted to circumvent the front support bar 32 of the reversing table 30. The collars 120, 122 may be conveniently made of materials similar to the reversing table 30, such as steel, iron, etc. Alternatively, the collars may be made of any stress and water resistant material such as a high impact plastic. Located on the top surface of the collars 120, 122 are ears 121, 123 respectively. Each ear 121, 123 is provided with an opening 124, 125 respectively, for receiving one end of the lifting cable 66 as illustrated in FIG. 12.

The collars 120, 122 are also provided with positioning strut attachment ears 126, 127 to enable the positioning struts 100, 102 to be rotatably placed thereon. The manner of attaching positioning struts 100, 102 to the support frame 40 is similar to that described above with respect to the preferred embodiment. It is also within the scope of the present invention to simply attach an additional set of attachment ears to the support frame 40 in lieu of an attachment plate 94.

The manner of operation of the embodiment illustrated in FIGS. 10–12 is similar to that with respect to the preferred embodiment with the following exception: instead of having track members 70, 74, the collars 120, 122 will slide directly upon the left and right hand portions of the support bar 32.

Figure 13:
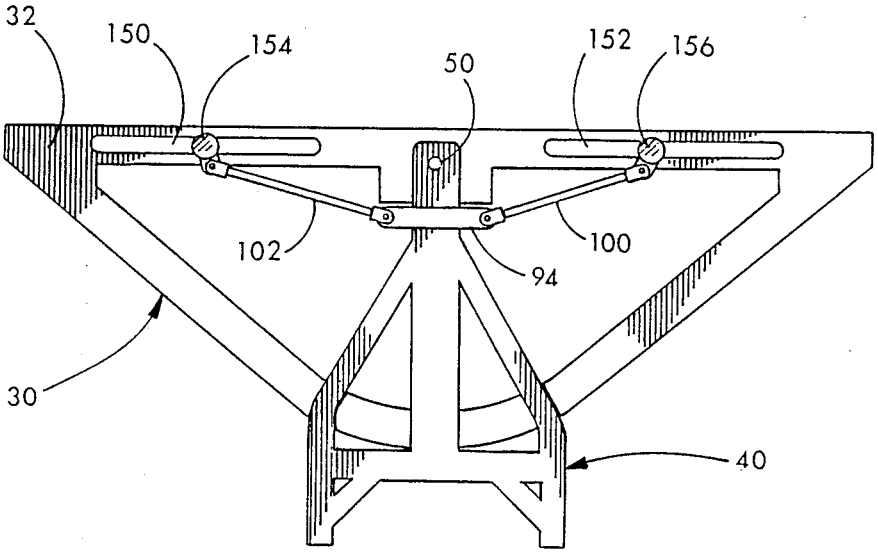
FIG. 13 is a bottom elevational view of a reversing table and support frame of a snowplow illustrating a third embodiment of the present invention.
Figure 14:
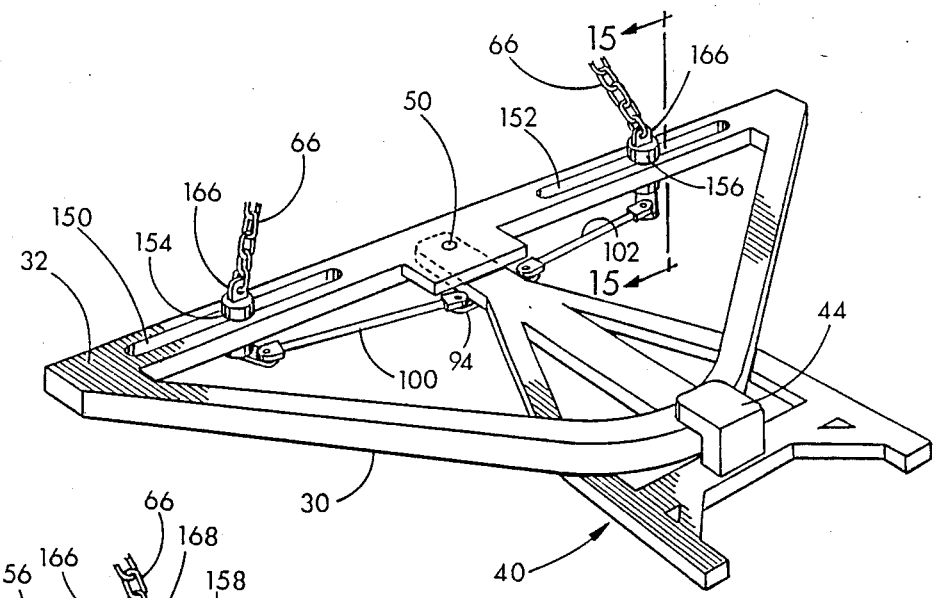
FIG. 14 is a perspective view of the invention of FIG. 13.
Figure 15:
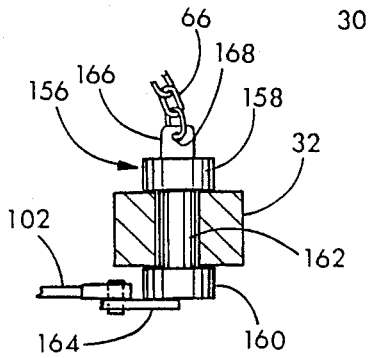
FIG. 15 is a cross-sectional view of the invention of FIG. 13 taken along lines 15—15 of FIG. 14.

Reference is now made to FIGS. 13–15 for a third emodiment of the present invention. This embodiment includes track members 150 and 152 which are designed as openings running lengthwise between the top surface and the bottom surface of the front support bar 32. Slidably located within track members 150, 152 are positioning pins 154, 156. Referring now more specifically to FIG. 15, the positioning pins 154, 156 include a first collar disc 158 and a second collar disc 160 fixedly attached to either end of an elongated shaft 162. The diameter of the shaft 162 is slightly smaller than the width of the track 150, 152 in order to allow the positioning pins 154, 156 to slidably move within the tracks 150, 152 respectively. Further, the length of the shaft 162 is slightly longer than the distance between the top surface and the bottom surface of the front support bar 32 in order to facilitate movement of the positioning pins within the track. The collar discs 158, 160 are at least slightly larger than the width of the tracks in order to prevent the positioning pin from dropping through the tracks. Although a cylindrical elongated shaft 162 is illustrated, it is within the scope of the present invention to provide a shaft having a shape other than cylindrical.

The bottom collar disc 160 includes an ear mount 164 fixedly attached. The positioning struts 100, 102 are then hingedly attached at one end to the ear mount 164 of each of the positioning pins 154, 156. The positioning struts 100, 102 are then attached at the other end to the attachment plate 94 in a manner similar to that described with respect to the first and second embodiments.

Located on the upper collar disc 158 of positioning pins 154, 156 is an ear mount 166 being provided with an opening 168 for attachment of the lifting chain 66 thereon.

In operation, as the reversing table 30 is rotatably moved about support frame 40, the positioning pins 154, 156 are allowed to move within tracks 150, 152 respectively in order to maintain continuous leveling action at all positions of the leveling table.

Figure 16:
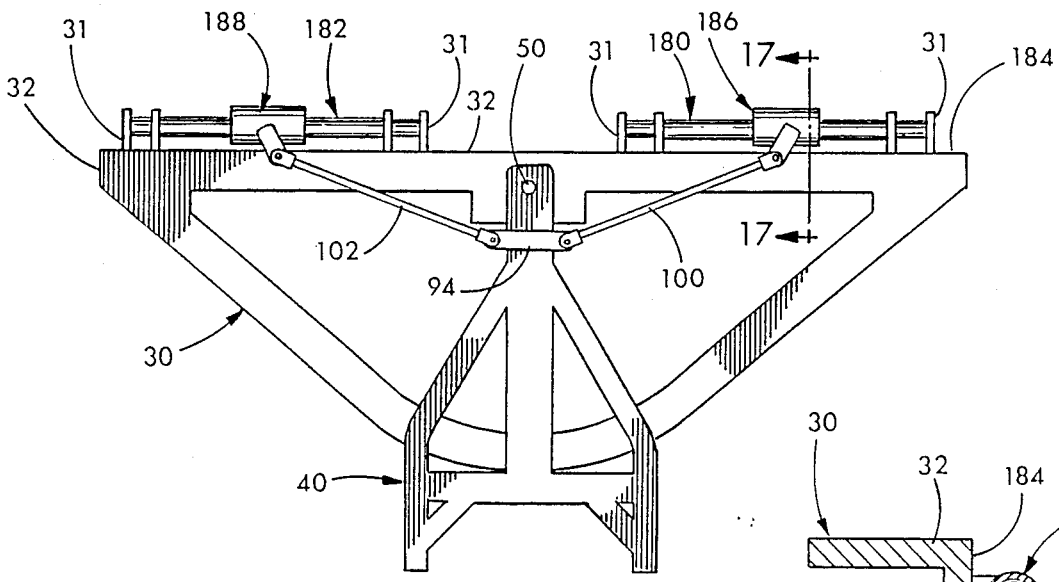
FIG. 16 is a bottom elevation view of a reversing table and support frame of a snowplow illustrating a fourth embodiment of the present invention.
Figure 17:
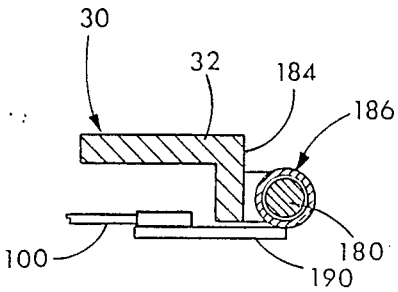
FIG. 17 is a cross-sectional view of the invention of FIG. 16 taken along lines 17—17 of FIG. 16.

Reference is now made to FIGS. 16 and 17 for a fourth embodiment of the present invention. This embodiment is similar to the first embodiment in that there is provided slider mechanism on a track. Unlike the first embodiment, however, the left and right track members 180, 182 are positioned between the plow blade lugs 31, which are in turn fixedly attached to the forward edge 184 of front support bar 32. Track members 180, 182 are generally cylindrical in shape and provided with cylindrical left and right slider members 186, 188.

Attached to the sliders 186, 188 are mounting ears 190, to which are hingedly attached the positioning struts 100, 102. The positioning struts are then attached to attachment plate 94 in a manner similar to the above-referenced embodiments. The manner of operation of this embodiment is similar to that with respect to the first embodiment, with the exception that, instead of placement of the track member on the bottom surface of the front support bar 32, the track members are placed on the front edge 84 of the front support member between mounting ears 31.

Figure 18A:
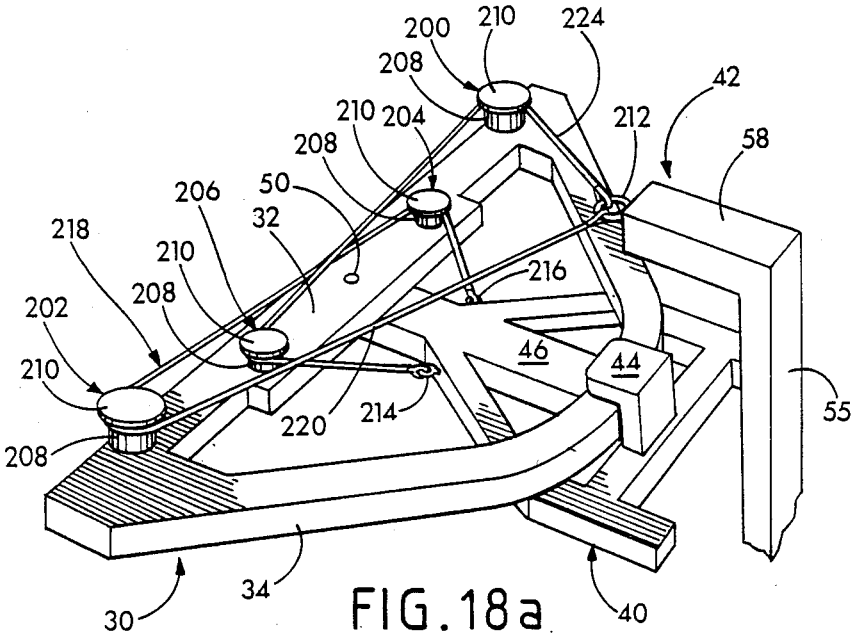
FIG. 18*a* is a simplified perspective view of the snowplow system,,illustrating a fifth embodiment of the present invention.
Figure 18B:
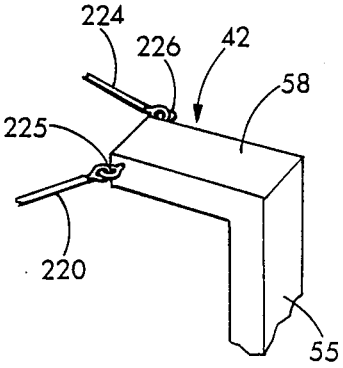
FIG. 18*b* is a partial simplified perspective view of the snowplow system of FIG. 18*a*, illustrating another embodiment of the cable connection to the lift arm.
Figure 19:
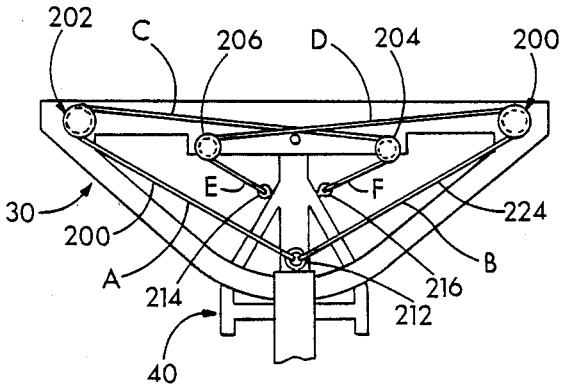
FIG. 19 is a top elevation view of the snowplow system of FIG. 18 in a straight ahead position.
Figure 20:
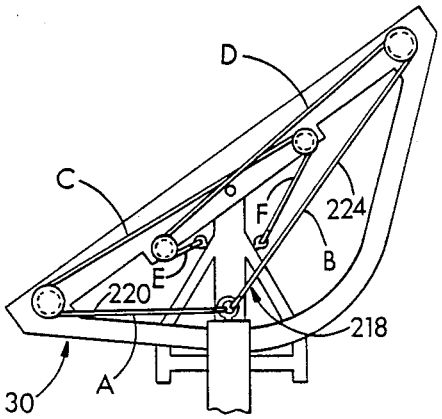
FIG. 20 is a top elevation view of the snowplow system of FIG. 18 in a full left position.

Reference is now made to FIGS. 18–21 for a fifth embodiment of the present invention. The basic structure of this embodiment is similar to the other embodiments in that there is provided a leveling system including a reversing table 30 having a front support bar 32 and an angle brace 34, a support frame 40 and a lift arm 42. The lift arm 42 includes an upright member 55 and a cantilever beam 58. Although not illustrated in FIGS. 18–21, other common features, such as the plow blade, positioning struts, and lifting cylinder are included within the scope of this embodiment. Unlike the other embodiments, however, the leveling system, as illustrated in FIGS. 18–20, includes a cable system slidably positioning the reversing tray 30 in a level position with respect to the support frame 40 and the lift arm 42.

Referring now more specifically to FIG. 18*a*, the front support bar 32 of the reversing tray 30 includes four guides: a right exterior guide 200, a left exterior guide 202, a right interior guide 204, and a left interior guide 206. Each of the guides 200, 202, 204 and 206 include a substantially cylindrical post 208 fixedly attached at its lower end to the front support bar 32 and at its upper end to a flange 210. The flange 210 has a greater diameter than the post 208, which purpose will be explained hereinafter. The lift arm 42 includes a first cable connection 212, comprising an eyelet or other means for holding one end of a cable system 218. The support frame 40 includes a second cable connection, including a left cable connection point 214 and a right cable connection point 216.

The cable system 218 is divided into two separate cables, a left cable 220 and a right cable 224. The ends opposite the cable connections 214, 216 are then fixedly attached to the lift arm 42 at either cable connection 212, as illustrated in FIG. 18*a*, or cable connections 225 and 226 as illustrated in FIG. 18*b*. The cable system 218 is designed to be slidably positioned around the guides and affixed to the connection points. The cable system 218 may be formed of any flexible, breakage resistant material, such as steel.

Referring back to FIG. 18*a*, the cable system, including the cable 218, is designed to be positioned on the leveling device in the following manner. The left cable 220 is passed from the connection point 212 around the left exterior guide 202 to and around the right interior guide 204 and is affixed at connection point 216. The right cable 224 is passed from the connection point 212 around the right exterior guide 200 to and around left interior guide 206 and is fixedly attached at the connection point 214. The cables 220, 224 are designed to be slidably positioned around all of the guides 200, 202, 204 and 206, and maintained around the guide posts 208 by means of the flange 210. Additionally, the cable system 218 will be provided with little or no slack tension about the various guides, the effect of which is to maintain the reversing tray 30 at a level position with respect to the ground and/or cantilever beam 58 of the lift arm 42.

Figure 21:
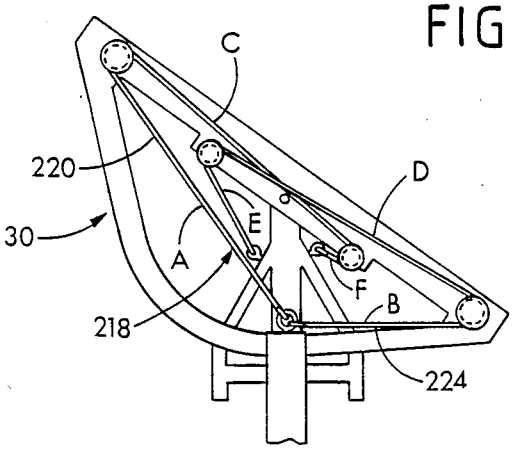
FIG. 21 is a top elevation view of the snowplow system of FIG. 18 in a full right position.
Figure 22:
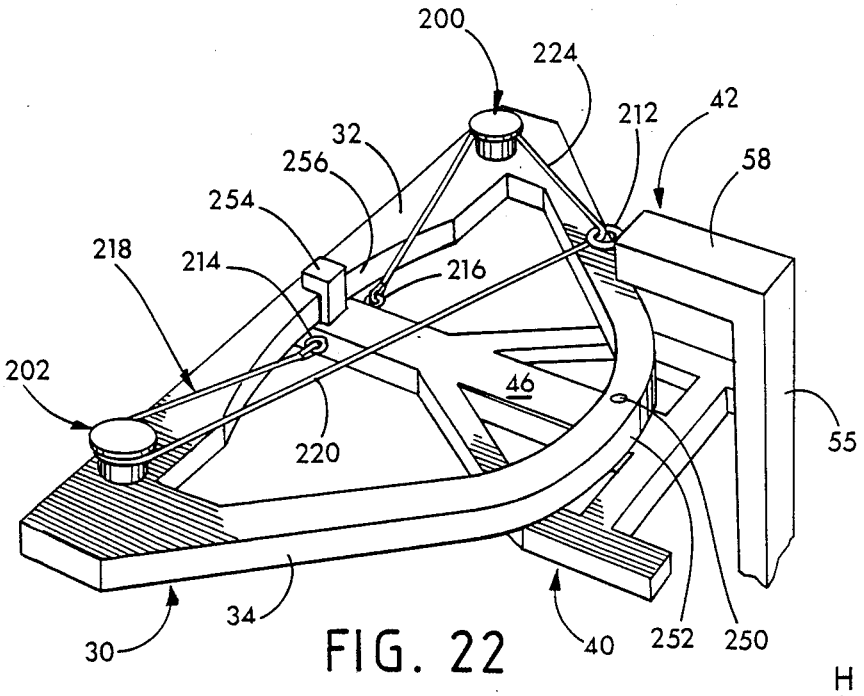
FIG. 22 is a simplified perspective view of the snowplow system illustrating a sixth embodiment of the present invention.

Referring now to FIGS. 19–21, the positioning of the cable 218 with respect to the guides 200, 202, 204 and 206 determine the facing direction of the reversing table 30. As with the prior embodiments, the reversing table 30 is rotated about the support frame 42 by means of reversing cylinders 62 (not illustrated in FIGS. 18–21) to pivot the reversing table 30 about the king pin 50. By expanding one reversing cylinder while contracting the other, the reversing table may be placed at any desired plowing angle ranging from the straight ahead or bulldozed plowing angle of FIG. 19 to the full left plowing angle of FIG. 20 to the full right plowing angle of FIG. 21.

When the reversing table 30 is in the bulldozed position of FIG. 19, there is symmetry in the positioning of the left cable 220 with respect to the right hand cable 224. In other words, the distance between the connection point 212 and the left exterior guide 202, hereinafter referred to as distance A, is identical to the distance between the connection point 212 and the right exterior guide 200, hereinafter referred to as distance B. Similarly, the distance between the left exterior guide 202 and the right interior guide 204, hereinafter referred to as distance C, is identical to the distance between the right exterior guide 200 and the left interior guide 206, hereinafter referred to as distance D. Additionally, the distance between the left interior guide 206 and the left connection 214, hereinafter referred to as distance E, is identical to the distance between the right interior guide 204 and the right connection 216, hereinafter referred to as distance F. At all times, the sum of the distances A, C and F will be equal to the sum of the distances B, D and E.

As the plowing angle is changed to a full left position, illustrated in FIG. 20, by rotating the reversing table 30 with respect to the support frame 40, distance A is considerably reduced with respect to distance B. The reduction in the length of distance A is offset by the increase in length of distance F. Likewise, the extension of the length in distance B is offset by the decrease of length in distance E. Distances C and D remain the same. In this manner, the cable system 218 maintains complete and proper tension about each of the guides thereby negating any tendency of the reversing table to tilt or droop.

Referring now to FIG. 21, as the plowing angle of the reversing table 30 is changed by rotation to a full right position, the length in the distances A, B, E and F are the reversed. As a result of the change in the distances of these lengths, the total length of the left cable 220, made up of distances A, C and F, always remain equivalent to the total length of the right cable 224, which is made up of distances B, D and E. Thus, the counteracting changes in distances between the portions of the cable result in maintaining the reversing table 30 at a position level to the ground with respect to the support frame 42.

Reference is now made to FIGS. 22–25 for a sixth embodiment of the present invention. The sixth embodiment is similar to the fifth embodiment in that the snowplow leveling system employs the use of a cable system slidably positioning the reversing tray 30 in a level position with respect to the support frame 40 and the lift arm 42. The system disclosed in this embodiment differs in the way the reversing table 30 is rotatably attached to the support frame 40. Unlike the other embodiments, the reversing table 40 employs a kingpin 250 which rotatably joins the reversing table 30 to the center support bar 46 of support frame 40 at the arc 252 of the angle brace 34. An overhanging projecting member 254 is now placed at the forward portion of the center support 46. The front support bar 32 of the reversing table 30 is distinguished from the other embodiments by circumferential cut out portion 256. The shape of the cut out portion 256 is designed such that there is an equal radial distance between the king pin 250 and any location of the cut out portion 256. The projecting member 254 is designed to overlap the front support bar 32 of the reversing table 30 at the location of the cut out portion 256. In this manner, the position of the rotatable reversing tray 34 is maintained at at least two points: the king pin 250 and the overhanging projection member 254 when the reversing table 34 is at any position with respect to the support frame 40. The reversing table 34 is designed to rotate only to the end limits of the cut out portion 256.

Unlike the embodiments featured in FIGS. 18–21, the reversing table 30 is distinguished by only two guides: a right exterior guide 200 and a left exterior guide 202. The lift arm includes the cable connection 212, comprising an eyelet or other means for holding the cable system 218. The support frame 40 includes a second system of cable connections, including the left cable connection point 214 and the right cable connection point 216.

The cable system 218 is designed to be slidably positioned around the guides 200, 202 and affixed to the connection points 214, 216. The cable system 218 is generally a one-piece cable, formed of any flexible, breakage resistant material, such as steel. In this manner, the connection point 212 forms a slidable loop through which the cable 218 slides. The left portion of cable 218, as it leaves the connection point 212, is designated by reference numeral 220, and the right portion by reference numeral 224.

The cable system 218 is designed to be positioned on the leveling device in the following manner. The left cable portion 220 is guided from the connection point 212 around the left exterior guide 202 and is affixed at connection point 214. The right cable portion 224 is guided from the connection point 212 around the right exterior guide 200 and is affixed at connection point 216. The cable portions 220, 224 are designed to be slidably positioned around the guides 200, 202. Like the embodiment featured in FIGS. 18–21, the cable system 218 of this embodiment will be provided with little or no slack tension about the various guides, the effect being to maintain the reversing tray 30 at a level position with respect to the ground and/or cantilever beam 58 of the lift arm 42.

Figure 23:
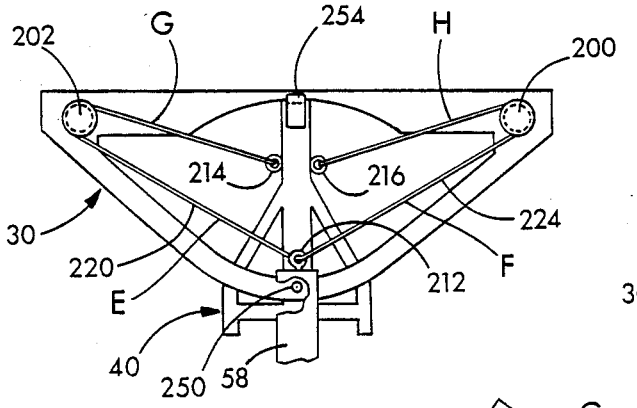
FIG. 23 is a top elevation view of the snowplow system of FIG. 22 in a straight ahead position.
Figure 24:
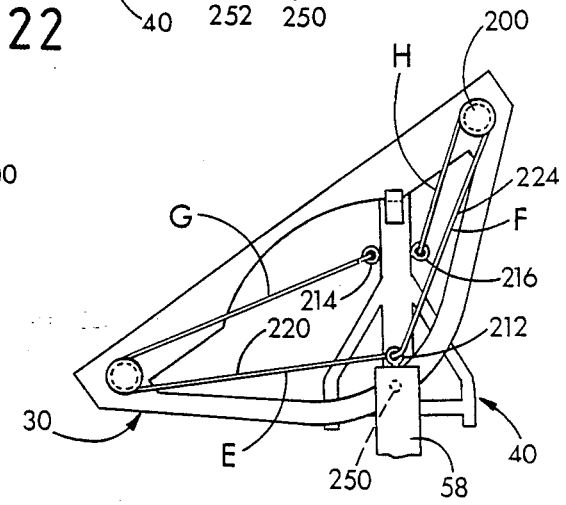
FIG. 24 is a top elevation view of the snowplow system of FIG. 22 in a full left position.
Figure 25:
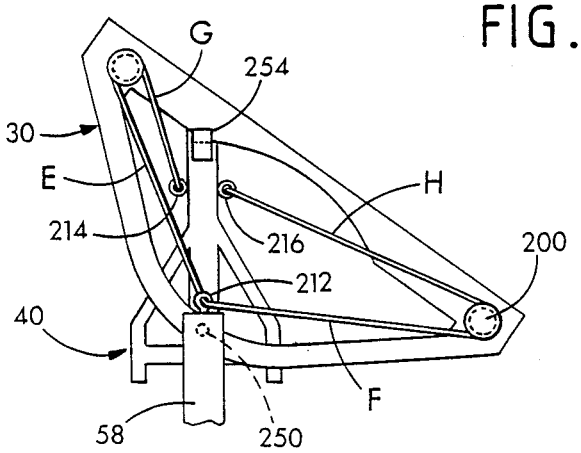
FIG. 25 is a top elevation view of the snowplow system of FIG. 22 in a full right position.

Referring now to FIGS. 23–25, the positioning of the cable system 218 with respect to the guides 200, 202 and the connection points 212, 214, 216 will now be discussed. As with the prior embodiments, the reversing table 30 is rotated about the support frame 42 by means of reversing cylinders 62 (not illustrated in FIGS. 22–25) to pivot the reversing table about a kingpin. By expanding one reversing cylinder while contracting the other, the reversing table 30 may be placed at any desired plowing angle ranging from the straight ahead or bulldozed plowing angle of FIG. 23 to the full left plowing angle of FIG. 24 to the full right plowing angle of FIG. 25. Unlike the prior embodiments, the reversing table 30 is rotated about the support frame 42 by means of kingpin 250 attached to the reversing table at the arc 252 of the angle brace 34. In this manner, the arc 252 of the reversing table will always be situated at the rear portion of the center support bar 46.

When the reversing table 30 is in the bulldozed position of FIG. 23, there is symmetry in the positioning of the left cable portion 220 with respect to the right cable portion 224. It is to be noted that the distance from the connection point 212, hereinafter referred to as distance E will always be identical to the distance between the connection point 212 and the right exterior guide 200, hereinafter referred to as distance F. Similarly, the distance between the left exterior guide 202 and the left connection point 214, hereinafter referred to as distance G is identical to the distance between the right exterior guide 200 and the right connection point 216, hereinafter referred to as distance H.

As the plowing angle is changed to a full left position, illustrated in FIG. 24, by rotating the reversing table along the kingpin 250, distance H is considerably reduced with respect to distance G. The reduction in length of distance H is offset by the increase in length in distance G. Again, the distances E and F remain equal.

Referring now to FIG. 25, as the plowing angle of the reversing table 30 is changed by rotation to a full right position, the length in the distances G and H are reversed. However, the total length of distances G and H remain the same and equal to distances G and H in FIGS. 23 and 24. Thus, the counteracting changes in the differences between the cable portions will result in maintaining the reversing table 30 at a position level to the ground with respect to support frame 42.

It should be noted that the snowplow leveling system of this invention may be adapted to snowplows of varying profile and length mounted on reversing tables and support frames of any standard structure. Furthermore, the reversing cylinders could be replaced by a system of manually inserted pins and pinholes in the reversing table and supporting frame for manually altering the plowing angle.

This invention is also embodied in a kit for modifying prior art snowplows to give the snowplow leveling features of this invention to previously constructed plows. A kit would consist of a left and right slider, either of the preferred or optional embodiment, two positioning struts, an attachment plate, and a left track and a right track if necessary. Such a conversion kit could be installed by a skilled mechanic, welder, or plow maintainance technician.

It is understood that the invention is not confined to the particular construction and arrangement herein illustrated and described, but embraces such modified forms thereof as come within the scope of the following claims.

What is claimed is:

1. A plow blade leveling system comprising:

(a) a plow blade support frame and a lift arm adapted to be attached to a motor vehicle, the lift arm including means to slidably receive a lifting chain;

(b) a reversing tray including a front support bar having a first end, a second end, a top surface, a bottom surface and a forward side, the reversing tray being mounted on the support frame, the reversing tray being further adapted to receiver a plow blade or a brush thereon;

(c) means for adjusting the angle of the reversing table with respect to the plow blade support frame, said means for adjusting having a first end connected to the reversing tray and a second end connected to the support frame; and (d) a leveling device slidably connecting the support frame to the reversing tray in order to maintain the reversing tray in a position level to the ground.

2. The plow blade leveling system of claim 1 wherein the angle of the reversing tray is adjusted by hydraulic cylinders.

3. The plow blade leveling system of claim 1 comprising means slidably mounting the leveling device to the front support bar of the reversing tray.

4. The plow blade leveling system of claim 1 further comprising a first positioning strut having a first end and a second end and a second positioning strut having a first end and a second end wherein the positioning struts hingedly connect the reversing tray to the support frame.

5. The plow blade leveling system of claim 4 wherein the leveling device comprises a first collar hingedly attached to the first end of the first positioning strut and a second collar hingedly attached to the first end of the second positioning strut, wherein the second ends of the first and second positioning struts are hingedly attached to the front support bar such that the first collar is slidably attached to the front support bar at a location near the first end of the front support bar and the second collar is slidably attached to the front support bar at a location near the second end of the front support bar.

6. The plow blade leveling system of claim 5 wherein the front support bar comprises a first separate track member having a defined length and a second separate track member having a defined length, wherein the first and second collars are slidably positioned on the track members.

7. The plow blade leveling system of claim 6 wherein the track members are fixedly attached to the bottom surface of the front support bar.

8. The plow blade leveling system of claim 7 wherein the lifting chain has a first end and a second end, the first end being connected to the first collar and the second end being connected to the second collar.

9. The plow blade leveling system of claim 6 wherein the reversing table further includes at least two lugs on the forward side, for receiving the plow blade or brush thereon, wherein the first and second track members are fixedly attached between the two lugs.

10. The plow blade leveling system of claim 9 wherein the lifting chain has a first end and a second end, the first end being connected to the first collar and the second end being connected to the second collar.

11. The plow blade leveling system of claim 6 wherein the track members and the collars are cylindrical in shape.

12. The plow blade leveling system of claim 5 wherein the lifting chain has a first end and a second end, the first end being connected to the first collar and the second end being connected to the second collar.

13. The plow blade leveling system of claim 5 wherein the first and second collars are slidably mounted directly to the front support bar such that the front support bar is a track member upon which the first and second collars are mounted.

14. The plow blade leveling system of claim 13 wherein the lifting chain has a first end and a second end, the first end being connected to the first collar and the second end being connected to the second collar.

15. The plow blade leveling system of claim 4 wherein the front support bar comprises a first track member and a second track member, the first track member and the second track member being defined by openings between the top surface and the bottom surface of the front support bar, the system further comprising a first positioning pin connected to one end of a first positioning strut, wherein the first positioning pin is slidably located in the first track member and the second positioning pin is slidably located in the second track member.

16. The plow blade leveling system of claim 15 wherein the lifting chain has a first end and a second end, the first end being connected to the first positioning pin and the second end being connected to the second positioning pin.

17. A plow blade leveling system comprising:

(a) a plow blade support frame and lift arm adapted to be attached to a motor vehicle, the support frame including means to slidably receive a lifting chain, wherein the lifting chain has a first end and a second end;

(b) a reversing tray including a front support bar having a first end, a second end, a top surface, a bottom surface and a forward side, the reversing tray being rotatably mounted on the support frame, the reversing tray being adapted to receive a plow blade thereon for plowing; and (c) a leveling device slidably mounted to the front support bar of the reversing tray in order to maintain the reversing tray in a position level to the ground, wherein the leveling device comprises a first collar hingedly attached to one end of a first positioning strut and a second collar hingedly attached to one end of a second positioning strut, wherein the other ends of the first and second positioning struts are hingedly attached to the front support bar such that the first collar is slidably attached to the front support bar at a location near the first end and the second collar slidably attached to the front support bar at a location near the second end, wherein the front support bar further comprises a first separate track member having a defined length and second separate track member having a defined length, wherein the first and second collars are slidably positioned on the track members.

18. The plow blade leveling system of claim 17 wherein the first and second track members are fixedly attached to the bottom surface of the front support bar.

19. The plow blade leveling system of claim 17 wherein the reversing table further includes at least two lugs on the forward side for receiving the plow blade thereon, wherein the first and second track members are fixedly attached between the two mounts.

20. A snowplow comprising:

(a) a motorized vehicle;

(b) a plow blade support frame removably attached to the motorized vehicle, wherein the support frame includes means to slidably receive a lifting chain;

(c) a reversing tray including a front support bar having a first end and a second end, the reversing tray being rotatably mounted on the support frame;

(d) means for adjusting the angle of the reversing table with respect to the plow blade support frame, said means for adjusting having a first end connected to the reversing tray and a second end connected to the support frame;

(e) a plow blade removably mounted on the reversing tray; and (f) a leveling device slidably connecting the reversing tray to the support frame to maintain the reversing tray in a position level to the ground.

21. The snowplow of claim 20 wherein the leveling device is slidably mounted to the front support bar of the reversing tray.

22. The snowplow of claim 21 wherein the leveling device comprises a first collar hingedly attached to one end of a first positioning strut and a second collar hingedly attached to one end of a second positioning strut, wherein the other end of the first and second positioning struts are hingedly attached to the front support bar such that the first collar is slidably attached to the front support bar at a location near the first end and the second collar is slidably attached to the front support bar at a location near the second end.

23. The snowplow of claim 22 herein the front support bar comprises a first separate track member and having a defined length and a second separate track member having a defined length, wherein the first and second collars are slidably positioned on the track members.

24. The snowplow of claim 23 wherein the lifting chain has a first end and a second end, the first end being connected to the first collar and the second end being connected to the second collar.

25. The plow blade leveling system of claim 24 wherein the track members are fixedly attached to the bottom surface of the front support bar.

26. The plow blade leveling system of claim 24 wherein the reversing table further includes at least two mounts on the forward side for receiving the plow blade thereon, wherein the first and second track members are fixedly attached between the two lugs.

27. The plow blade leveling system of claim 24 wherein the first and second collars are slidably mounted directly to the front support bar such that the front support bar is a track member upon which the first and second collars are mounted.

28. The plow blade leveling system of claim 21 wherein the front support bar comprises a first track member and a second track member, the first track member and the second track member being defined by openings between the top surface and the bottom surface of the front support bar, the system further comprising a first positioning pin connected to one end of a first positioning strut and a second positioning pin connected to one end of a second positioning strut, wherein the first positioning pin is slidably located in the first track member and the second positioning pin is slidably located in the second track member.

29. In a snowplow system, including a motor vehicle, a plow blade support frame and lift arm attached to the motor vehicle, the support frame including means to slidably receive a lifting chain, a reversing tray including a front support bar having a first end and a second end, the reversing tray being rotatably mounted to the support frame, means to rotate the reversing tray on the support frame, said means to rotate having a first end connected to the reversing tray and a second end connected to the support frame and a plow blade mounted on the reversing tray, the improvement comprising a leveling device slidably attaching the support frame to the reversing tray to maintain the reversing tray in a position level to the ground.

30. The snowplow system of claim 29 comprising means slidably mounting the leveling device to the front support bar of the reversing tray.

31. The snowplow system of claim 30 wherein the leveling device comprises a first collar hingedly attached to one end of a first positioning strut and a second collar hingedly attached to one end of a second positioning strut, wherein the other end of the first and second positioning struts are hingedly attached to the front support bar such that the first collar is slidably attached to the front support bar at a location near the first end and the second collar is slidably attached to the front support bar at a location near the second end.

32. The snowplow system of claim 31 wherein the front support bar comprises a first separate track member having a defined length and a second separate track member having a defined length, wherein the first and second collars are slidably positioned on the track members.

33. The snowplow system of claim 32 wherein the track members and the collars are cylindrical in shape.

34. The snowplow system of claim 31 wherein the lifting chain has a first end and a second end, the first end being connected to the first collar and the second end being connected to the second collar.

35. A plow blade leveling system comprising:

(a) a plow blade support frame and a lift arm adapted to be attached to a motor vehicle;

(b) a reversing tray including a front support bar having a first end, a second end, a top surface, a bottom surface and a forward slide, the reversing tray being rotatably mounted on the support frame, the reversing tray being further adapted to receive a plow blade thereon for plowing;

(c) means for adjusting the angle of the reversing table with respect to the plow blade support frame said means for adjusting having a first end connected to the reversing tray and a second end connected to the support frame; and (d) a leveling device connecting the support frame to the reversing tray including a cable system slidably positioning the reversing tray in a level position with respect to the support frame and the lift arm.

36. The plow blade leveling system of claim 35 wherein the front support bar of the reversing tray includes a right guide and a left guide, wherein the lift arm includes a first cable connection, wherein the support frame includes a second cable connection, and wherein the cable system includes a cable having two ends each of which is affixed to the second cable connection, the cable being further slidably positioned on the guides and the first cable connection such that the reversing tray remains level at any position of rotation with respect to the support frame.

37. The plow blade leveling system of claim 35 wherein the front support bar of the reversing tray includes a right exterior guide, a left exterior guide, a right interior guide and a left interior guide, wherein the lift arm includes a first cable connection, wherein the support frame includes a second cable connection, and wherein the cable system includes a first flexible cable which is fixedly attached to the second cable connection and slidably positioned around the left exterior guide and the right interior guide and fixedly attached to the first cable connection, and second flexible cable is fixedly attached to the second cable connection and slidably positioned around the right exterior guide and the left interior guide and fixedly attached to the first cable connection such that the positioning of the first and second flexible cables around the interior and exterior guides keeps the reversing tray level at any position of rotation with respect to the support frame.

38. The plow blade leveling system of claim 35 wherein the reversing tray is rotated by hydraulic cylinders.

39. A snowplow comprising:

(a) a motorized vehicle;

(b) a plow blade support frame and a lift arm removably attached to the motorized vehicle;

(c) a reversing tray rotatably mounted on the support frame, the reversing tray including a front support bar having a front end, a second end, a top surface, a bottom surface and a forward side, the reversing tray being further adapted to removably receiver a plow blade therein for plowing;

(d) means for adjusting the angle of the revering table with respect to the plow blade support frame; said means for adjusting having a first end connected to the reversing tray and a second end connected to the support frame;

(e) a plow blade removably mounted on the reversing tray; and (f) a leveling device connecting the support frame to the reversing tray including a cable system slidably maintaining the reversing tray at a level position with respect to the support frame and the lift arm.

40. The plow blade leveling system of claim 39 wherein the front support bar of the reversing tray includes a right guide and a left guide, wherein the lift arm includes a first cable connection, wherein the support frame includes a second cable connection, and wherein the cable system includes a cable having two ends each of which is affixed to the second cable connection, the cable being further slidably positioned on the guides and the first cable connection such that the reversing tray remains level at any position of rotation with respect to the support frame.

41. The plow blade leveling system of claim 40 wherein the front support bar of the reversing tray includes a right exterior guide, a left exterior guide, a right interior guide and a left interior guide, wherein the lift arm includes a first cable connection, wherein the support frame includes a second cable connection, and wherein the cable system includes a first flexible cable which is fixedly attached to the second cable connection and slidably positioned around the left exterior guide and the right interior guide and fixedly attached to the first cable connection, and second flexible cable is fixedly attached to the second cable connection and slidably positioned around the right exterior guide and the left interior guide and fixedly attached to the first cable connection such that the positioning of the first and second flexible cables around the interior and exterior guides keeps the reversing tray level at any position of rotation with respect to the support frame.

42. A leveling kit adapted to fit onto a plow blade system including a plow blade support frame and a lift arm wherein the lift arm includes means to receive a lifting chain, a reversing tray including a front support bar having a first end, a second end, a top surface, a bottom surface and a forward side, wherein the reversing tray is mounted on the support frame and the reversing tray is further adapted to receive a plow blade or a brush thereon, and means to rotate the reversing tray with respect to the support frame, said means to rotate having a first end connected to the reversing tray and a second end connected to the support frame wherein the leveling kit maintains the reversing tray in a position level to the ground; the leveling kit comprising:

(a) a leveling device connecting the support frame to the reversing tray slidably mounted to the front support bar of the reversing tray; and (b) at least one positioning strut hingedly connecting the reversing tray to the support frame.

43. The leveling kit of claim 42 further comprising a first positioning strut having a first end and a second end and a second positioning strut having a first end and a second end wherein the positioning struts hingedly connect the reversing tray to the support frame.

44. The leveling kit of claim 43 wherein the leveling device comprises a first collar hingedly attached to the first end of the first positioning strut and a second collar hingedly attached to the first end of the second positioning strut, wherein the second ends of the first and second positioning struts are hingedly attached to the front support bar such that the first collar is slidably attached to the front support bar at a location near the first end of the front support bar and the second collar is slidably attached to the front support bar at a location near the second end of the front support bar.

45. The leveling kit of claim 43 wherein the lifting chain has a first end and a second end, the first end being connected to the first collar and the second end being connected to the second collar, wherein the lift arm includes means to slidably receive the lifting chain.

46. A leveling kit adapted to fit onto a plow blade system including a plow blade support frame and a lift arm wherein the lift arm includes means to receive a lifting chain, a reversing tray including a front support bar having a first end, a second end, a top surface, a bottom surface and a forward side, wherein the reversing tray is mounted on the support frame and the reversing tray is further adapted to receive a plow blade or a brush thereon, and means to rotate the reversing tray with respect to the support frame, said means to rotate having a first end connected to the reversing tray and a second end connected to the support frame wherein the leveling kit is connected the support frame and the reversing tray and maintains the reversing tray in a position level to the ground; the leveling kit comprising a cable system slidably positioning the reversing tray in a level position with respect to the support frame and the lift arm.

47. The leveling kit of claim 46 wherein the front support bar of the reversing tray includes a right guide and a left guide, wherein the lift arm includes a first cable connection, wherein the support frame includes a second cable connection, and wherein the cable system includes a cable having two ends each of which is affixed to the second cable connection, the cable being further slidably positioned on the guides and the first cable connection such that the reversing tray remains level at any position of rotation with respect to the support frame.

48. The leveling kit of claim 46 wherein the front support bar of the reversing tray includes a right exterior guide, a left exterior guide, a right interior guide and a left interior guide, wherein the lift arm includes a first cable connection, wherein the support frame includes a second cable connection, and wherein the cable system includes a first flexible cable which is fixedly attached to the second cable connection and slidably positioned around the left exterior guide and the right interior guide and fixedly attached to the first cable connection, and the second flexible cable is fixedly attached to the second cable connection and slidably positioned around the right exterior guide and the left interior guide and fixedly attached to the first cable connection such that the positioning of the first and second flexible cables around the interior and exterior guides keeps the reversing tray level at any position of rotation with respect to the support frame.

* * * * *